US006189230B1

(12) United States Patent
Huen

(10) Patent No.: US 6,189,230 B1
(45) Date of Patent: Feb. 20, 2001

(54) ELECTRIC HAND DRYER AND TOWEL DRYER

(75) Inventor: Hing Wah Huen, Kowloon (HK)

(73) Assignee: Oasis Global Limited, Kowloon (HK)

( * ) Notice: Under 35 U.S.C. 154(b), the term of this patent shall be extended for 0 days.

(21) Appl. No.: 09/348,465

(22) Filed: Jul. 7, 1999

(51) Int. Cl.[7] ..... F26B 19/00
(52) U.S. Cl. ..... 34/90; 34/210
(58) Field of Search ..... 34/60, 90, 91, 34/104, 202, 209, 210, 233, 619, 621; 392/380, 382, 384; 223/52, 63, 67

(56) References Cited

U.S. PATENT DOCUMENTS 3,417,481 * 12/1968 Rumsey, Jr. ..... 34/90
3,656,275 * 4/1972 Hunter ..... 55/174 X
4,856,206 * 8/1989 Klein ..... 34/239 X
5,107,603 * 4/1992 Durazzani ..... 34/90 X
5,222,308 * 6/1993 Barker et al. ..... 34/104
5,377,427 * 1/1995 Mashata ..... 34/275
5,442,867 * 8/1995 Robinson ..... 34/90
5,727,579 * 3/1998 Chardack ..... 134/95.2
6,035,545 * 3/2000 Jones ..... 34/202

* cited by examiner

*Primary Examiner*—Stephen Gravini
(74) *Attorney, Agent, or Firm*—Leydig, Voit & Mayer, Ltd.

(57) ABSTRACT

An electric hand and towel dryer includes an enclosure having an inlet and first, second, and third outlets for heated air. A tube associated with the second and third outlets connects to opposed air outlets in the enclosure. A blower unit incorporates a heating element, a motor, and a fan located inside a first chamber of the enclosure for generating a hot air stream. The stream selectively exits the enclosure through the first outlet or the second and third outlets. A folding blind controls the flow of the hot air through the first or second and third outlets for respectively drying hands or a towel supported on the hanger.

8 Claims, 2 Drawing Sheets

ELECTRIC HAND DRYER AND TOWEL DRYER

The present invention relates to an electric hand dryer which is capable of drying other items.

BACKGROUND OF THE INVENTION

Electric hand dryers for use in public toilets or washrooms are generally known, and provide a hot air stream for blow-drying the hands of a user. For domestic use, in particular, there are items other than hands, such as towels or cloths, that may need drying, but the conventional hand dryers are not useful for this purpose.

The invention seeks to provide an improved electric hand dryer which solves this problem.

SUMMARY OF THE INVENTION

According to the invention, there is provided an electric hand dryer comprising a body having an inlet and first and second outlets for air and a hanger associated with the second outlet, a blower unit incorporating a heating element and a motor-driven propeller provided inside the body for generating a hot air stream to exit the body through either outlet, and a manually movable operator for controlling the flow of the hot air stream to exit through either the first outlet for drying the hands of a user or the second outlet for drying a towel or the like supported on the hanger.

Preferably, the operator is movable between a first position opening the first outlet and disabling the second outlet and a second position closing the first outlet and enabling the second outlet.

More preferably, the first outlet is substantially aligned with the blower unit and the second outlet is provided downstream from the first outlet.

Further more preferably, the operator is provided between the first outlet and the blower unit.

In a preferred embodiment, the body has first and second chambers associated with the first and second outlets respectively and separated by a partition having a hole, and the operator is arranged for the blower unit to supply the hot air stream to the first chamber for exit through the first outlet when the operator closes the hole and to supply the hot air stream to the second chamber, via the first chamber, for exit through the second outlet when the operator reveals the hole.

It is preferred that the operator is in the form of a folding blind.

More preferably, an external knob is provided on the body for moving the operator.

In a preferred embodiment, the hanger is in the form of a hollow bar having an open end connected to the body at where the second outlet is such that the interior of the bar is in communication with that of the body, said bar having small apertures for discharging the hot air to dry a towel or the like supported on the bar.

More preferably, the body has two said second outlets on opposite sides, and the bar is U-shaped and has opposite open ends connected to the body at where the respective second outlets are.

BRIEF DESCRIPTION OF DRAWINGS

The invention will now be more particularly described, by way of example only, with reference to the accompanying drawings, in which.

DETAILED DESCRIPTION OF PREFERRED EMBODIMENTS

Figure 1:
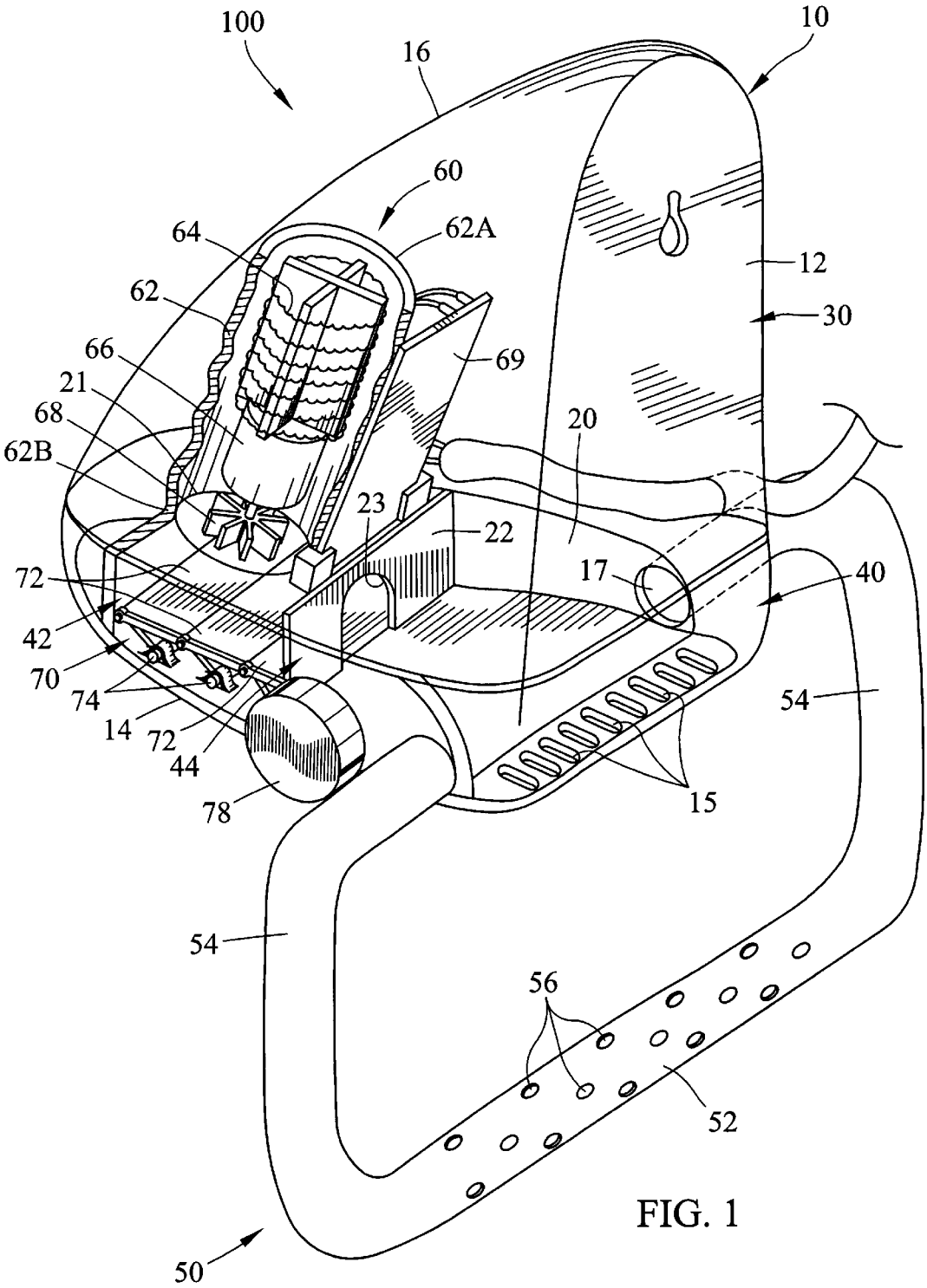
FIG. 1 is a see-through rear perspective view of an embodiment of an electric hand dryer in accordance with the invention.
Figure 2:
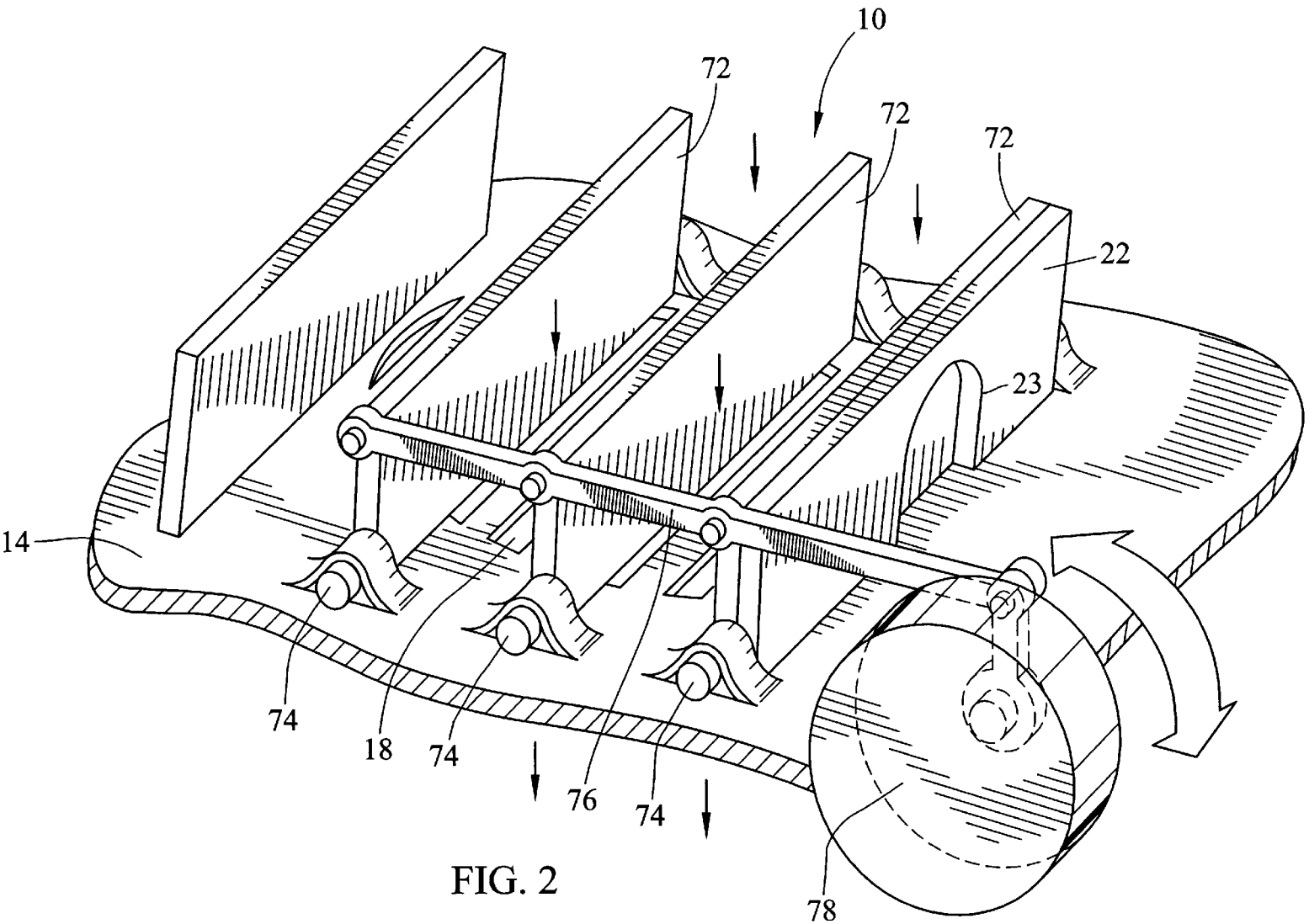
FIG. 2 is a perspective view of part of the hand dryer of FIG. 1, shown in a different operating condition.

Referring to the drawings, there is shown an electric hand dryer 100 embodying the invention, which hand dryer 100 has a hollow body 10 formed by a vertical rear wall 12, a bottom wall 14 extending from the rear wall 12, and a curved front cover wall 16 enclosing the space between the rear wall 12 and the bottom wall 14. The interior of the body 10 is divided, by a generally horizontal partition 20, into a relatively larger top chamber 30 and a relatively smaller bottom chamber 40. The rear part of the partition 20 curves down to meet the body bottom wall 14, reaching short of the body rear wall 12. As between the partition 20 and the body rear wall 12, the body bottom wall 14 has a series of slots 15 which together act as an inlet for air to enter the top chamber 30 from outside the body 10.

The interior of the bottom chamber 40 is divided, by means of a vertical partition 22 having a hole 23, into a front chamber 42 and a rear chamber 44. In relation to the front chamber 42, the horizontal partition 20 and the body bottom wall 14 have respective circular apertures 21 and 18 in alignment with each other. For the rear chamber 44, opposite left and right sides of the cover wall 16 have respective circular apertures 17 aligned with each other. Insofar as the body 10 is concerned, the bottom aperture 18 acts as a first outlet for air, and the two side apertures 17 together act as a second outlet.

Attached below the body 10 is a U-shaped hollow or tubular bar 50, which has a horizontal middle portion 52 for hanging a towel or the like and includes a pair of opposite side limbs 54. The side limbs 54 are connected at their open ends to respective left and right sides of the cover wall 16 where the apertures 17 are, such that the interior of the bar 50 is in communication with the rear chamber 44. Several lines of small holes 56 are formed on and around the middle portion 52 of the bar 50.

The hand dryer 100 includes a blower unit 60 located inside the top chamber 30. The blower unit 60 includes a tubular sleeve 62 and, co-axially within the sleeve 62, an electrical heating element 64, an electric motor 66 and a propeller 68 driven by the motor 66. The heating element 64 and the propeller 68 are positioned at respective upper and lower open ends 62A and 62B of the sleeve 62. The sleeve 62 is connected at its lower end 62B to the aperture 21 on the horizontal partition 20. An electronic control circuit mounted on a printed circuit board 69 is provided on one side of the sleeve 62 for controlling the operation of the blower unit 60.

While the blower unit 60 is in operation, the propeller 68 drives air down the sleeve 62 past the heating element 64, whereby a stream of hot air is generated for entering into the front chamber 42 and then the rear chamber 44. Accordingly, the two side apertures 17 (the second outlet of the body 10) are provided downstream from the bottom aperture 18 (the first outlet).

Inside the front chamber 42, a horizontal folding blind 70 is provided between the blower unit 60 and the bottom aperture 18. The blind 70 includes a series of three slats 72 which are connected to the body bottom wall 14 by means of respective pairs of hinges 74 at opposite ends. The slats 72 are linked together at their ends by means of an upper linkage bar 76 for simultaneous pivotal movement. An external turning knob 78 is provided on the same side of the body 10, which is eccentrically connected to the linkage bar 76 for opening and closing the blind 70.

The slats 72 are pivotable between a generally horizontal position covering the bottom aperture 18 and a vertical position revealing the aperture 18. The slat 72 closest to the vertical partition 22 is arranged in the vertical position to cover the hole 23 of the partition 22, thereby cutting off communication from the front chamber 42 to the rear chamber 44 and thus disabling the side apertures 17. While in the horizontal position, that specific slat 72 reveals the partition hole 23 and thus enables the side apertures 17.

The folding blind 70 controls the flow of the hot air stream to enter into either the front chamber 42 only for exit through the bottom aperture 18 or the rear chamber 44, via the front chamber 42, for exit through the side apertures 17.

When the blind 70 is in the condition with its slats 72 standing upright, the hot air stream is expelled from the body 10 directly through the bottom aperture 18. In this condition, the hand dryer 100 operates as a conventional hand dryer to dry the hands of a user. When the blind 70 is in the alternative condition, with its slats 72 lying down, the hot air stream is compelled to enter into the rear chamber 44 and subsequently leave the body 10 through the side apertures 17. As a result, the hot air stream enters the bar 50 (via the apertures 17) and is finally discharged through the holes 56 of the bar 50. In this condition, the hand dryer 100 operates as a towel dryer to dry a towel or the like hung on the bar 50.

The invention has been given by way of example only, and various modifications of and/or alterations to the described embodiment may be made by persons skilled in the art without departing from the scope of the invention as specified in the appended claims.

What is claimed is:

1. An electric hand and towel dryer comprising:

an enclosure having an air inlet and first and second chambers, the air inlet being in communication with the first chamber;

a heater, a motor, and a fan driven by the motor, located in the first chamber, for drawing air into the enclosure, heating the air, and discharging the air heated by the heater into the second chamber;

a partition including an internal opening, the partition being located in and dividing the second chamber into a front chamber and a rear chamber, the front and rear chambers communicating through the internal opening;

a first air outlet in the enclosure in the front chamber for discharging air heated by the heater;

opposed second and third air outlets in the rear chamber;

a tube connected to the enclosure, extending between and providing an air flow path between the second and third air outlets, the tube including plurality of holes in the tube and located between the second and third air outlets; and a manually movable operator movable between positions alternatively blocking flow of air heated by the heater through the first outlet and through the internal opening.

2. The electric hand and towel dryer as claimed in claim 1, wherein the first air outlet is coaxial with the motor and the fan.

3. The electric hand and towel dryer as claimed in claim 2, wherein the manually movable operator is located in the front chamber between the first air outlet and the fan.

4. The electric hand and towel dryer as claimed in claim 1, wherein the manually movable operator is a folding blind.

5. The electric hand and towel dryer as claimed in claim 4, including an external knob located on the enclosure for actuating the manually movable operator.

6. The electric hand and towel dryer as claimed in claim 4, wherein the folding blind includes a plurality of slats for blocking the flow of air through the first air outlet, one of the slats selectively blocking the flow of air through the internal opening in the partition.

7. The electric hand and towel dryer as claimed in claim 6, wherein each of the slats is independently hingedly connected to the enclosure and including links connecting pairs of slats for manual movement of the folding blind between positions.

8. The electric hand and towel dryer as claimed in claim 7, including an external knob having a link connected to one of the slats, the knob being located on the enclosure for manual movement of the folding blind between positions.

* * * * *